US007201675B2

(12) United States Patent
Morrison

(10) Patent No.: US 7,201,675 B2
(45) Date of Patent: Apr. 10, 2007

(54) GAME SYSTEM AND METHOD WITH ANGLED WALL UNITS

(76) Inventor: Alexander Morrison, 1711 Fulton St., Apt. 5O, Brooklyn, NY (US) 11233

( * ) Notice: Subject to any disclaimer, the term of this patent is extended or adjusted under 35 U.S.C. 154(b) by 0 days.

(21) Appl. No.: 11/006,512

(22) Filed: Dec. 6, 2004

(65) Prior Publication Data

US 2005/0170916 A1 Aug. 4, 2005

Related U.S. Application Data

(60) Provisional application No. 60/527,401, filed on Dec. 4, 2003.

(51) Int. Cl.
*A63B 69/00* (2006.01)

(52) U.S. Cl. ..... 473/434; 52/70

(58) Field of Classification Search ..... 473/434, 473/468, 465, 421, 447; 256/26; 52/64, 52/70, 72

See application file for complete search history.

(56) References Cited

U.S. PATENT DOCUMENTS 1,591,753 A * 7/1926 Flaugh ..... 473/421
2,827,295 A * 3/1958 Austin ..... 473/421
3,408,071 A * 10/1968 Lundy ..... 473/421
3,697,068 A 10/1972 McDougall
3,758,106 A * 9/1973 Liebig ..... 473/465
4,072,295 A * 2/1978 Roberts ..... 256/26
4,973,061 A * 11/1990 Catherall ..... 473/468
5,791,094 A * 8/1998 Thomson ..... 52/64
6,213,900 B1 4/2001 Steyn et al.

* cited by examiner

*Primary Examiner*—Eugene Kim
*Assistant Examiner*—M. Chambers
(74) *Attorney, Agent, or Firm*—Sofer & Haroun, LLP.

(57) ABSTRACT

An equipment for playing a game using a racquet and ball is provided having a substantially horizontal playing surface with first and second ends. A plurality of playing walls, disposed at the first end of the horizontal playing surface, extends perpendicularly away from the playing surface. A first playing wall among the plurality of playing walls is disposed centrally between a second and a third playing wall among the plurality of playing walls. The second playing wall and the third playing wall are angled relative to the first playing wall.

13 Claims, 3 Drawing Sheets

GAME SYSTEM AND METHOD WITH ANGLED WALL UNITS

RELATED APPLICATION

The present invention is related to and claims the benefit of priority from U.S. Provisional Patent Application No. 60/527,401, filed on Dec. 4, 2003, the entirety of which is incorporated herein by reference.

FIELD OF THE INVENTION

The present invention relates to system and method for a game played with a racquet and a ball on playing surface having angled walls.

BACKGROUND OF THE INVENTION

A number of games are currently played using a racquet and ball, most commonly tennis and racquetball. Although these games provide significant physical and mental challenges, their repeated play can become less challenging and lead to a diminished desire to play.

As such there exists a need to provide various alternatives to these basic games which provide variety beyond basic racquet and ball games.

OBJECT AND SUMMARY OF THE INVENTION

The present invention looks to overcome the drawbacks associated with the prior art racquet and ball games by providing a system and method for a game, played with a racquet and a ball which is played on a playing surface having angled walls.

To this end, the present invention provides for an equipment for playing a game using a racquet and ball. The equipment includes a substantially horizontal playing surface having a first and second ends. The equipment also includes a plurality of playing walls, disposed at the first end of the horizontal playing surface, extending perpendicularly away from the playing surface. A first playing wall among the plurality of playing walls is disposed centrally between a second and a third playing wall among the plurality of playing walls. The second playing wall and the third playing wall are angled relative to the first playing wall.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof may best be understood by reference to the following detailed description when read with the accompanying drawings in which:

DETAILED DESCRIPTION

The present invention relates generally to a game, preferably having two players, played with racquets, a rubber ball, a playing surface having a floor and three walls, the three walls being movable between different angles relative to one another before, and during the course of gameplay. A more detailed description of the playing surface is described in more detail below.

The game, played on the playing surface can be played with any scoring system, such as a best 2 of 3, or best 3 of 5, or any other similar scoring using a majority of a predetermined number of games. Similarly each individual game is won preferably when one player gains a larger number of points than his/her opponent, according to the rules and methods described below.

In addition to the below described playing surface the game is typically played with a racquet and ball. Preferably the ball used is a hollow rubber ball with mass and dimensions similar to the ball used in the existing game of racquetball. Preferably the racquet is to be of a similar mass, dimension and construction to the typical racquet used in the existing game of racquetball.

Figure 1:
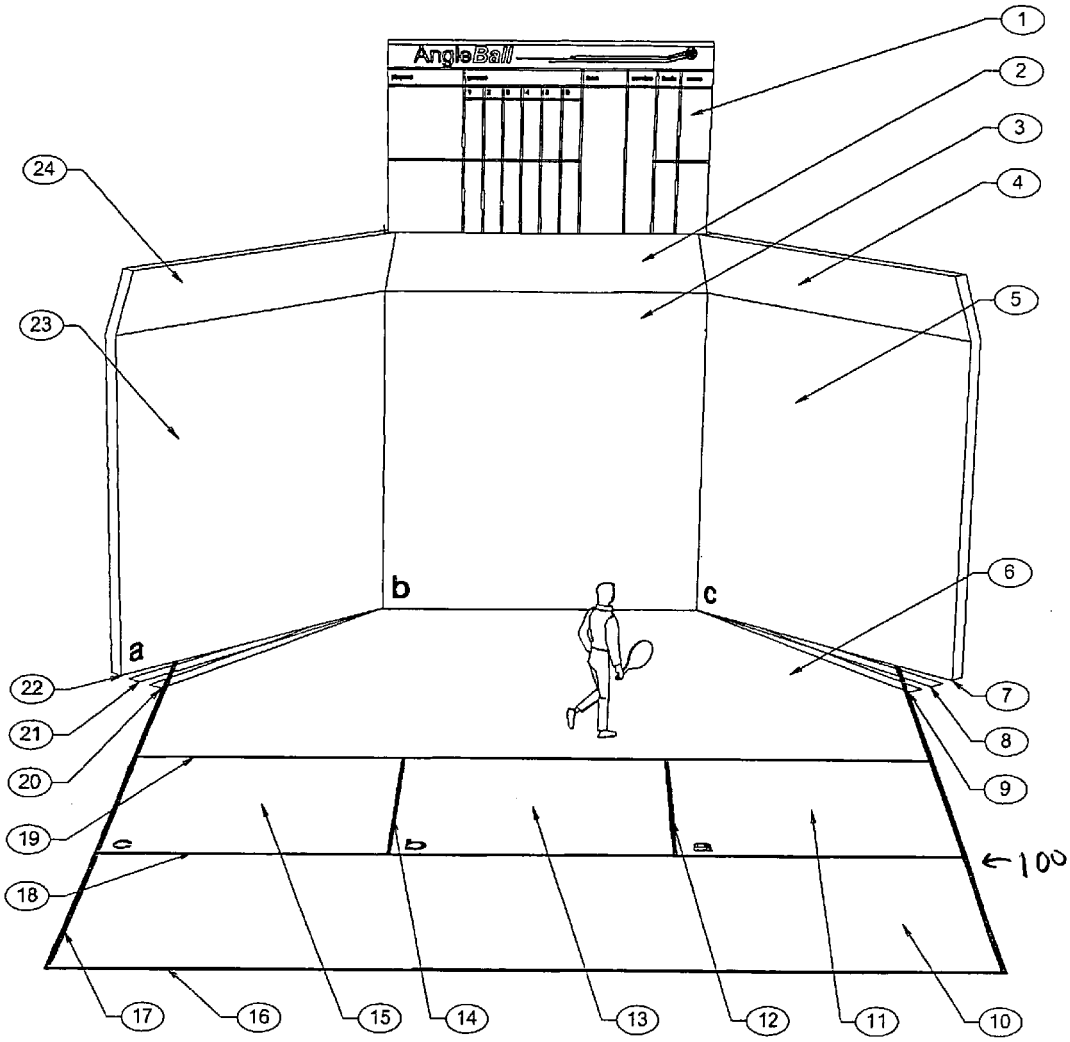
FIG. 1 is a front perspective view of a playing surface in accordance with one embodiment of the invention.
Figure 2:
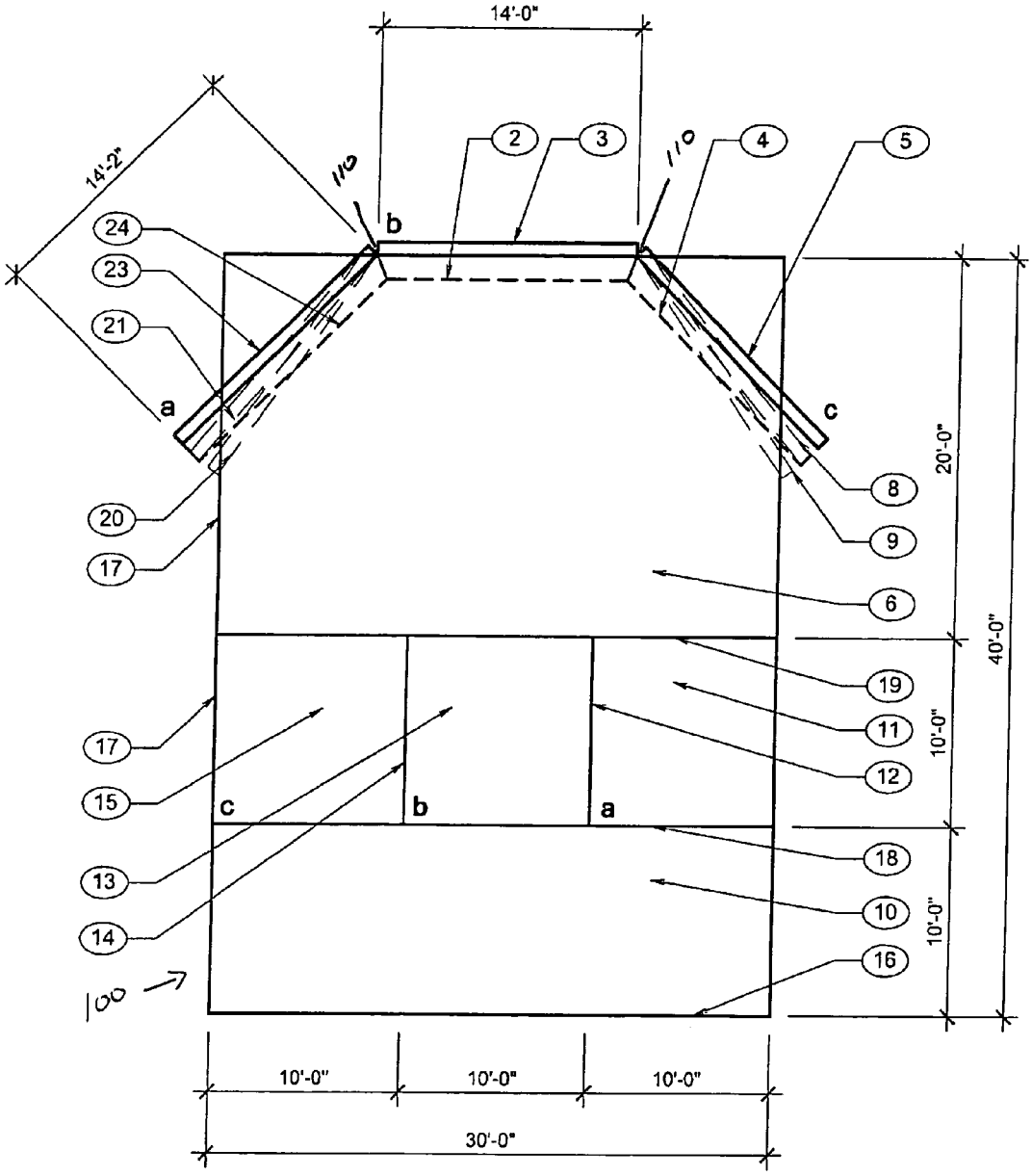
FIG. 2 is a top view of the playing surface from FIG. 1, in accordance with one embodiment of the invention.
Figure 3:
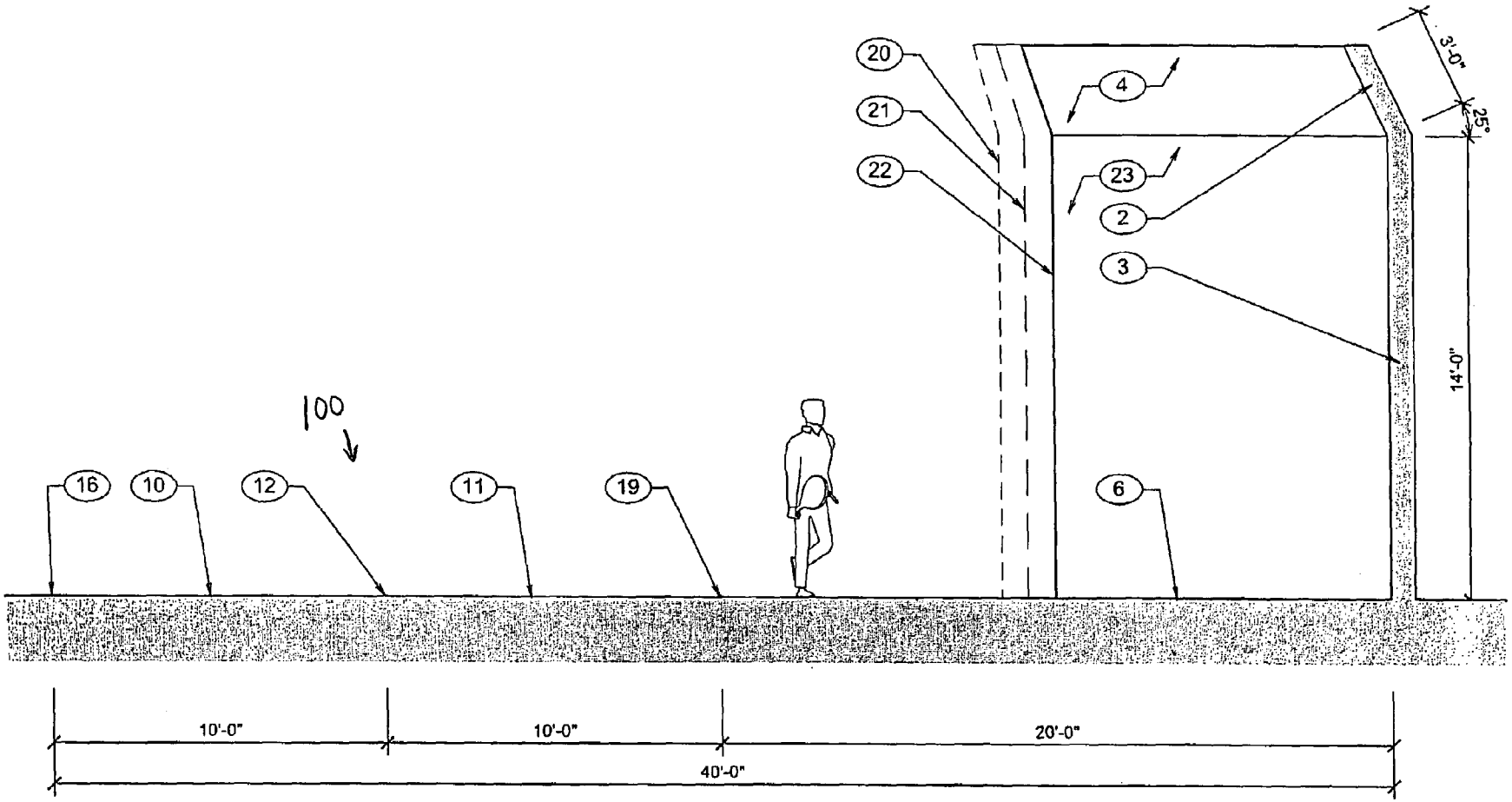
FIG. 3 is a side view of the playing surface of FIG. 1, in accordance with one embodiment of the invention.

In one embodiment of the present invention as shown in FIGS. 1–3, a playing surface 100 is shown. Playing surface 100 is typically constructed of a durable, hard, smooth material or system of materials to comprise a surface whose properties and nature are similar to those typically employed in the construction of courts for racquet sports. These materials may include, but are not limited to: wood, concrete, asphalt, clay, or other such materials.

Playing surface 100 preferably is constructed in a rectangle having length dimension of 40 feet from front to back and width dimension 30 feet from left to right, however, the invention is not limited in this respect. The rear of playing surface 100 is defined by rearcourt line 16 and the sides of playing surface 100 are defined by sidecourt lines 17. The front of playing surface 100 is supplied with three playing walls, namely left playing wall 23, center playing wall 3 and right playing wall 5, each abutting one another and each rising perpendicularly upwards from playing surface 100.

From front to back, playing surface 100 is divided into three sections: the forecourt 6, the serving boxes 11, 13, 15 and the rearcourt 10. Serving boxes include serving box a 11, serving box b 13, and serving box c 15. Forecourt 6 is preferably 20 feet lengthwise from front to back and extends the full width 30 feet of playing surface 100. Forecourt 6 is divided from the serving boxes by a forecourt line 10.

As illustrated in FIGS. 1 and 2, serving boxes 11, 13 and 15 are preferably 10 feet lengthwise from front to back and extend 10 feet in width from left to right. Serving boxes 11, 13 and 15 are arranged side by side across the width of the playing surface 100. Serving box a 11, serving box b 13 and serving box c 15 are preferably arranged from right to left across playing surface 100. Serve boxes 11, 13 and 15 are divided from each other by demarcation lines 14, 12. Serve-boxes are divided from rearcourt 10 by a service line 18. Rearcourt 10 is preferably 10 feet lengthwise from front to back and extends the full width 30 feet of playing surface 100.

It is understood that many of the elements, described above and shown in FIGS. 1 and 2 are also marked on FIG. 3. Although the elements are not necessarily visable on side view FIG. 3 they are marked to show their relative distances from playing walls 23, 3 and 5.

In one embodiment of the present invention as, illustrated in FIGS. 1–3, the front of playing surface 100, includes playing walls 23, 3, 5. These walls are labeled from left to right across playing surface 100 as left wall 'a' 23, center wall 'b' 3, and right wall 'c' 5. Playing walls 23, 3 and 5 are preferably constructed of a durable, hard, smooth material or system of materials to comprise a surface whose properties and nature are similar to those typically employed in the construction of walls used for racquet sports. These materials include, but are not limited to plywood on ribs or framing; gypsum board, cement board, fiberboard or similar material on ribs or framing; concrete or concrete block. It is noted that playing walls 23, 3 and 5, may be constructed using a transparent material to maximize the number of people that could view the players in a stadium or arena setting.

As illustrated in FIG. 2, playing walls 23 and 5 are preferably fastened to center wall 3 with a system of hinges 110, to allow the pivoting of the walls in accordance with the description below. However, the invention is not limited in this respect. For example, walls 23, 3 and 5 may all be independent of one another and simply placed or held by any means in the below described angled arrangements. For the purposes of illustration walls 23 and 5 are described as connected to center wall 3 by hinges 110.

Hinge 110 may be continuous or in sections and is sized according to the nature of the construction of playing walls 23, 3 and 5. Hinge 110 is located on the back side of walls 23, 3 and 5, so that the vertical joint between playing walls 23, 3 and 5 is tight and minimized on front surface of the walls, used to play the game.

Playing walls 23, 3 and 5 are preferably supported at their sidecourt ends, closer to sidecourt line 17, in such a way, dependant on the construction of walls 23, 3 and 5, to allow them to pivot in accordance with the description below. This support may include but is not limited to: casters, trucks, bearings, etc.

In one embodiment of the present invention, as illustrated in FIGS. 1–3, playing walls 23 and 5, are preferably 14 feet, 2 inches wide and 14 feet-0 inches high, with a minimized gap between playing surface 100 and the bottom of walls 23 and 5 to allow for the pivoting of these walls in accordance with the description below. Playing wall 3 is preferably 14 feet, 0 inches wide and 14 feet, 0 inches high.

Playing walls 23, 3 and 5 each have an angled top portion 24, 2 and 4 respectively. Top portions 24, 2 and 4 are substantially the same width of the walls they sit upon and have a true length height of 3 feet, 0 inches. Top surfaces 24, 2 and 4 are angled towards the main playing surface 100 at an angle of 25° from the vertical as shown in FIG. 3.

In one embodiment of the present invention, top portions 24, 2, and 4 are attached to tops of playing walls 23, 3 and 5 by hinges. The hinges allow top portions 24, 2 and 4, to pivot, varying the angle to greater or lesser than 25 degrees.

Playing walls 23 and 5 are able to pivot to one of three positions during the course of game play. This pivoting can be achieved through mechanical means, or by manual repositioning depending on the nature of their construction. The positions of the pivoting walls 23 and 5 for the purpose of gameplay is preferably angles of 45° from the plane of playing wall 3, towards playing surface 100, 50° from the plane of playing wall 3 towards playing surface 100 and 55° from the plane of playing wall 3 towards playing surface 100. These varied angles 500 and 55° for playing walls 23 and 5 are illustrated in FIG. 2 as positions 8 and 9 respectively. Playing walls 23, 3 and 5 may be moved manually, or alternatively, they may be moved by an automated system, such as chain drive, pneumatics, motor drive, or any other similar system. An automated system may involve a computer control as well, whereby the angles of playing walls 23, 3 and 5 can be controlled for automated shifts to appropriate playing angles based on the elapsed time during gameplay or possibly by a remote used by the players.

It is understood that the above described playing wall angles of 45 degrees, 50 degrees and 55 degrees are intended only as sample orientations and in no way limit the scope of the present invention. Playing walls 23, 3 and 5 can be set to be at any angle relative to one another based on the player's desire. For the purposes of illustration the above described angles are used in conjunction with the below described exemplary game play rules.

The angle of playing wall 23 from playing wall 3, towards playing surface 100, is preferably during gameplay matched to the angle of playing wall 5 from playing wall 3, towards playing surface 100.

In one embodiment of the present invention as illustrated in FIG. 1, scoring can either handled by handwritten cards (similar to golf or bowling), manual scoreboards (similar to large chalkboards, or old style ballfields), or electronic scoreboards 1 controlled by an operator, or connected to sensors on playing surface 100 and a computer to automatically tabulate and display the score. By whatever method used, scoreboard 1 preferably provides space for, record and display the following information: player names, set each player is currently playing in, official time clock and the time elapsed, number of fouls committed by each player, service sequence directions, degree of angle of sidewalls, number of service aces awarded to each player, and total points accumulated by each player.

In one embodiment of the present invention, gameplay on playing surface 100 is preferably conducted according to the following rules. It is understood that playing surface 100 may be used for any purpose at all, regardless of the game played. However, for the purposes of illustrating a particular use for playing surface 100, the following gameplay is described in accordance with one embodiment of the invention.

Each game is based on a 30 minute duration which is preferably divided into 6 sets of 5 minutes each. Each player is preferably given 2.5 minutes of service within each set, to score as many points against his/her opponent by following specific serve patterns, outlined below. Playing walls 23 and 5 are positioned at different yet symmetrical angles during different sets according to the pattern outlined below.

The serve patterns, outlined below in Table 1, are the shots that must be successfully achieved by the player who is serving, for play to commence. The service shot must be made by a serving player hitting the ball from behind service line 18 to the designated wall, and landing in the designated service box 11, 13 or 15, without otherwise touching playing surface 100. The order of serve patterns followed in each 2.5 minute segment of play are as follows:

TABLE 1

| Set | Service Wall, Service Box | | | Angle of Walls 'a' & 'c' |
|---|---|---|---|---|
| 1 | aa | bb | cc | 45 |
| 2 | aa | ba | cc | 55 |
| 3 | aa | bb | cb | 55 |
| 4 | ab | bb | cc | 50 |
| 5 | bb | ca | cc | 50 |
| 6 | aa | bc | cc | 45 |

An opposing player must then return the ball, utilizing any combination of playing walls 23, 3 or 5, so that the ball strikes one of playing walls 23, 3 or 5, or combination thereon, before landing on playing surface 100. If the opposing player is unable to return the ball, points are awarded to the serving player and the next service pattern within the set is utilized.

Play progresses with each player taking alternating turns returning the ball on its first bounce from playing surface 100, to playing walls 23, 3 and 5. If either player is unable to return the ball, points are awarded to the other player as outlined below and the next service pattern within the set is utilized. Although the players may utilize playing surface 100 as well as the areas outside playing surface 100 to conduct the game, the ball may only make contact with playing walls 100 or the playing surface within sidecourt 17 and rearcourt lines 16.

If in the course of the 2.5 minute service within the set, the serving player has run through all three serving patterns, subsequent serving patterns should be a repetition of the previous three.

At the end of the 2.5 minute service, the ball is given to the opposing player for their 2.5 minutes of service, following the same service pattern for the set. When both players have played their 2.5 minute service segments within the set—then the next set is begun.

Again, it is understood that this is only intended as one example of gameplay method that can be conducted using playing surface 100. However, any similar game utilizing playing walls 23, 3 and 5 with playing surface 100, is within the contemplation of the present invention.

In one embodiment of the present invention, assuming the gameplay follows the above described exemplary rules, points are awarded to the player who completes a shot that hits one or more of playing walls 23, 3 and 5, bounces from playing surface 100 and is not returned by the opposing player. Preferably the points awarded are based on the point value of playing walls 23, 3 or 5 that are struck by the ball before such a shot is completed. Playing walls 23 and 5 have values of 2 points, with center playing wall 3 having a value of 1 point.

In another possible scoring method, if in the course of play, a player completes a shot that hits all three playing walls 23, 3 and 5 (angleball), bounces from playing surface 100 and is not returned by the opposing player—then that player is awarded the total point value of all three playing walls 23, 3 and 5 (2+1+2=5 points) is awarded. However, if the opposing player is able to return this 'angleball' in such a way that the initializing player is not able to consequently return the ball then this opposing player is awarded the 5 points.

In another possible scoring method, if in the course of play, a player completes a serve in accordance with one of the service patterns described above and the opposing player is unable to return the serve, then the serving player is awarded 4 points.

In another possible scoring method, if a player accumulates a total of 6 of any of the following fouls during the course of play, then the offending player forfeits the remaining time of their service set and the opposing player is given service.

Fouls include but are not limited to: if during service, the player serving does not successfully complete a service pattern, with the ball landing in the designated service box 11, 13 or 15; if during service, the player serving serves the ball in such a way that it bounces from playing surface 100 before hitting designated playing wall 23, 3 or 5; if during service, the player hits the ball out of the bounds of playing surface 100 without first completing the designated service pattern; if during the course of play, a player is hit with any playing equipment (other then the ball). Such fouls are registered against the player whose equipment did the hitting.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

The invention claimed is:

1. An equipment for playing a game using a racquet and ball, said equipment comprising:

a substantially horizontal playing surface, having a first and second ends; and a plurality of playing walls, disposed at said first end of said horizontal playing surface, extending perpendicularly away from said playing surface, wherein a first playing wall among said plurality of playing walls is disposed centrally between a second and a third playing wall among said plurality of playing walls, and wherein said second playing wall and said third playing wall are angled relative to said first playing wall during the game; and wherein said playing surface and said plurality of playing walls are made of a rigid material capable of rebounding said ball on impact and said playing walls are the first walls intended to receive a returned ball and wherein the angle between said first playing wall and said second playing wall and the angle between said second playing wall and said third playing wall is set by an automated system including either a chain drive or a pneumatic movement and wherein said automated system to set the angles between said playing walls is computer controlled.

2. The equipment as claimed in claim 1, wherein said playing surface is subdivided into a forecourt, three service boxes and a rear court.

3. The equipment as claimed in claim 2, wherein said plurality of playing walls are located in said forecourt of said playing surface.

4. The equipment as claims in claim 1, wherein said plurality of playing walls are coupled to one another via hinges.

5. The equipment as claimed in claim 1, wherein the angle between said first playing wall and said second playing wall and the angle between said second playing wall and said third playing wall is the same.

6. The equipment as claimed in claim 5, wherein the angle between said first playing wall and said second wall and the angle between said second playing wall and said third playing wall is 45 degrees.

7. The equipment as claimed in claim 5, wherein the angle between said first playing wall and said second wall and the angle between said second playing wall and said third playing wall is 50 degrees.

8. The equipment as claimed in claim 5, wherein the angle between said first playing wall and said second wall and the angle between said second playing wall and said third playing wall is 55 degrees.

9. The equipment as claimed in claim 1, wherein said plurality of playing walls each maintain a top portion angled inwards towards said playing surface.

10. The equipment as claimed in claim 9, wherein said top portions of said playing walls, are angled towards said playing surface a an angle of 25 degrees.

11. The equipment as claimed in claim 1, wherein said computer is controlled by a remote.

12. The equipment as claimed in claim 1, wherein the angle between said first playing wall and said second wall is in the range of 0–90 degrees, and the angle between said second playing wall and said third playing wall is in the range of 0–90 degrees, wherein both said angle between said first playing wall and said second wall and said angle between said second playing wall and said third playing wall are determined by a computer generated random number.

13. The equipment as claimed in claim 1, wherein said playing walls are transparent.

* * * * *